US005170524A

United States Patent [19]

Vowles

[11] Patent Number: 5,170,524

[45] Date of Patent: Dec. 15, 1992

[54] TUBE CLEANING APPARATUS

[75] Inventor: Robert W. Vowles, North Melbourne, Australia

[73] Assignee: Barry Bros. Specialised Services Pty. Ltd., Victoria, Australia

[21] Appl. No.: 602,302

[22] PCT Filed: Mar. 31, 1989

[86] PCT No.: PCT/AU89/00133

§ 371 Date: Nov. 16, 1990

§ 102(e) Date: Nov. 16, 1990

[87] PCT Pub. No.: WO90/11843

PCT Pub. Date: Oct. 18, 1990

[51] Int. Cl.[5] ..... B08B 9/04

[52] U.S. Cl. ..... 15/3.51; 15/104.062; 165/95

[58] Field of Search ..... 15/3.5, 3.51, 104.062; 134/8; 165/95

[56] References Cited

U.S. PATENT DOCUMENTS 1,808,870 6/1931 Strasburg .
2,915,422 12/1959 Stone ..... 134/8
3,631,555 1/1972 Hurst et al. ..... 15/3.5
4,435,872 3/1984 Leikam ..... 15/104.06
4,724,007 2/1988 Barry et al. ..... 15/3.5

FOREIGN PATENT DOCUMENTS

18165/83 4/1988 Australia .
32187/84 5/1988 Australia .

*Primary Examiner*—Edward L. Roberts
*Attorney, Agent, or Firm*—Ernest V. Link

[57] ABSTRACT

A projectile launcher is disclosed and claimed adapted for use in apparatus for cleaning tubes arranged in apparatus being of the type whereby a projectile is placed in a tube to be cleaned and then subjected to a sudden cleaning medium pressure impact to force the projectile through the tube at high speed, the launcher with the tube to be cleaned, a magazine for feeding serially projectiles into the tube to be cleaned, and means for supplying a pulse of cleaning medium along the aforesaid duct once a projectile is positioned in the tube to be cleaned, the barrel and the cleaning medium duct being selectably removable from the launcher to be replaced with similar barrels and cleaning medium ducts to accommodate projectiles of differing diameters without loss of any operating fluids from the launcher.

12 Claims, 7 Drawing Sheets

TUBE CLEANING APPARATUS

FIELD OF THE INVENTION

The present invention relates to apparatus for the cleaning of tubes, in particular tubes arranged in regular arrays such as those forming part of multi-tube heat transfer devices such as boilers, tube and shell type heat exchangers and condensers. More particularly, the present invention relates to parts of tube cleaning apparatus including launchers of cleaning projectiles and refinements to the barrels and muzzles of launchers to improve their engagement with the ends of tubes to be cleaned.

BACKGROUND OF THE INVENTION

Tubes in multi-tube heat transfer devices usually require cleaning on a regular basis. For the most part, this is accomplished by lancing, a manual or partly-mechanized process in which the nozzle of a flexible or rigid lance, emitting high velocity jets of water, is passed through each tube. When manually performed, lancing is an arduous, dirty and dangerous task. Large volumes of effluent are generated, which often contains toxic substances. The cleaning jets of high velocity water are capable of inflicting severe injury. Environmental regulations governing the disposal of effluent are strict and the production of minimal effluent volume is thus desirable. A rigid lance must be as long as a tube to be cleaned if cleaning is to be effected in a single pass. Particularly in long tubes, manipulation of lances generally and the head space required for deployment of rigid lances often represent a considerable problem.

Australian Patent Applications Nos. 18,165/83 and 32,187/84 disclose a method of cleaning multi-tube heat transfer devices such as boilers, condensers and heat exchangers. In the method disclosed therein, a tube is cleaned by propelling into and through it a projectile made to travel at high speed by means of a more or less instantaneous release of a pressurized liquid cleaning medium. In most applications, it is usual for the said cleaning medium to be water with typical working pressures ranging from 1,000 to 10,000 P.S.I.

The aforementioned patent specifications use the term "pig" to describe the said projectile, however, this terminology is considered not to be altogether appropriate as the cleaning method differs from the well-known pigging cleaning method in material ways. In pigging, the pig is constructed so that its outer or forward surfaces, or auxiliary scraping, abrading or brushing elements attached thereto, are kept firmly in mechanical contact with the inner surfaces of a pipe or tube being cleaned. The pig is drawn or propelled slowly through the tube or pipe, the said surfaces or auxiliary elements effecting the cleaning in a direct, mechanical way. In the present method, the projectile is made to have a light sliding fit in the bore of a tube to be cleaned or of a diameter to approximate the reduced lumen created within the tube by a heavy accretion of contaminant material. Thus it cannot itself mechanically remove contaminant material.

In operation, where a tube is completely blocked, the release of the pressurised cleaning medium causes the projectile to accelerate rapidly into the tube, whereupon the projectile and its propelling column of liquid cleaning medium are arrested violently by the projectile's coming into contact with the deposit of contaminant material. It is believed that the resultant water hammer effect causes an energetic shock to pass along the length of the tube, breaking the bond between its inner wall and the contaminant material. In some types of monolithic crystalline deposit, the said shock causes the contaminant material to revert to a granular or particulate form. The loosened contaminant material is ejected from the tube by the projectile, its progress through the tube being assisted by pressure pulses in the following column of cleaning medium. The said pressure pulses are generated by the action of the pistons of the multi-cylinder positive displacement type pump preferably employed to pressurized the said cleaning medium.

Where the progress of the projectile through the reduced lumen of a tube is impeded by a partial deposit of contaminant material, it is believed that a flow of pressurized cleaning medium may pass through the annular space between the projectile and the contaminant material, emerging at the front of the projectile in the form of a high velocity annular jet. It is thought that the jet serves to erode away from ahead of the projectile deposits of contaminant material, facilitating the progress of the projectile through the tube.

Where a projectile is able to pass through a tube unimpeded, as is the case in tubes containing contaminant material in the form of light, laminar deposits, it is believed that an energetic cleaning effect is generated in the cleaning medium in the wake of the said projectile and that this is related to the speed of the projectile. This effect, the nature of which is not yet fully understood, appears to involve the action of cavitation or a cavitation-like process. In all cases where a projectile is free to progress through a tube, it is not necessary for the projectile to contact the walls of the tube or the contaminant material adhering thereto for the said cleaning effect to be generated.

The aforementioned patent applications disclose a launcher which comprises a power cylinder in one end of which is slidably mounted a barrel member, and a piston movable within the said cylinder, said piston being fixed to a cleaning medium duct made coaxial with it and the said cylinder such that forward movement of the piston causes the said cleaning medium duct to pass up the barrel member of the launcher, pushing a projectile from a storage magazine mounted upon the barrel member and causing the projectile to travel up the said barrel and into a tube to be cleaned adjacent the end of and collinear with which the muzzle of the said barrel member has been positioned. In the final part of its forward movement, the said piston contacts the inner end of the said barrel member, causing the barrel member to move bodily forward in its said slidable mounting in the end of the said cylinder, against the pressure of a restoring spring, and press its muzzle firmly against the end of the tube to be cleaned. A flow of high pressure cleaning medium is then released through the said cleaning duct propelling the projectile through the tube and generating a cleaning effect.

SUMMARY OF THE INVENTION

The present invention provides various improvements in the previously described launcher which provide amongst other things, greater utility in that projectiles of a range of sizes may be accommodated. The present invention in accordance with preferred aspects also encompasses:

(i) means of adapting muzzles of launcher barrels to the ends of tubes to be cleaned; and (ii) a mounting means for launchers to accommodate some degree of misalignment between the launcher muzzle and a tube to be cleaned;

All of the forms of launchers depicted herein comprise the following common elements: a piston operating in a power cylinder to actuate a cleaning medium duct which is slidably accommodated within a barrel. A magazine for the storage of projectiles is mounted upon the barrel, and the barrel is capable of forward extension or the whole launcher assembly is capable of bodily forward movement to bring the barrel muzzle firmly into contact with the end of a tube to be cleaned.

In summary, the functions performed by the launcher are the taking of a projectile from a storage magazine, its insertion into the end of a tube to be cleaned, the sealing of the launcher barrel muzzle against the end of the tube, and the conducting of a flow of liquid cleaning medium into the tube to propel the projectile through it.

In accordance with one aspect of the present invention, there is provided a launcher for placing projectiles into a tube to be cleaned and enabling cleaning medium to be supplied to a said projectile placed in a tube to be cleaned to propel said projectile along said tube during a cleaning operation, said launcher comprising a barrel alignable with the tube to be cleaned, projectile supply means for feeding a said projectile into said barrel, a cleaning medium duct slidably accommodated in said barrel and adapted to push the projectile located in said barrel into the tube to be cleaned upon movement of said cleaning medium duct forwardly along said barrel, means enabling movement of at least an end zone of said barrel into engagement with or around the tube to be cleaned, and means for directing a cleaning medium pulse along said cleaning medium duct against the projectile previously located in said tube to be cleaned, said launcher being characterized in that at least said barrel selectably removable from said launcher to enable use of differing sized projectiles in the cleaning of said tubes. Conveniently, the cleaning medium duct is actuated pneumatically or hydraulically and means are provided to prevent loss of pressurised air or hydraulic fluid when the cleaning medium duct and barrel are replaced. Conveniently, the barrel may be mounted for limited radial movement relative to a said tube to be cleaned thereby allowing for any possible mis-alignment between the barrel and the tube.

Where a launcher is made without provision to extend its barrel as a whole so that its muzzle is brought into firm contact with the end of a tube to be cleaned, this function may be achieved through the incorporation of an extensible element into the launcher barrel. Additionally, in the majority of applications, it is necessary for the barrel muzzle of a launcher to have more or less the same internal diameter as that of the tube to be cleaned. Where it is not possible to obtain a pressure seal around the external periphery of the tube end, or against the adjacent tube sheet surface, it is necessary to obtain a pressure seal against the inner surfaces of the tube or to interpose an adapter between the barrel muzzle of the launcher and the end of the tube, which adapter sealingly engages both.

According to a further aspect of this invention there is provided in a launcher for projectiles used in cleaning of tubes, a muzzle mechanism arranged to contact or surround a selected tube to be cleaned, said muzzle mechanism comprising a barrel adapted to feed a said projectile into said tube, a cleaning medium supply duct movable through said barrel to move said projectile into the tube to be cleaned and a contact member adapted to contact or surround the tube, said contact member being spring loaded for movement relative to said barrel in a direction away from said tube to be cleaned, and means for selectively moving said contact member against said spring loading towards said tube to be cleaned.

Conveniently the contact member is moved towards the tube to be cleaned by engagement with said barrel moving towards the said tube.

In accordance with another aspect of the present invention there is provided a launcher for projectiles used in tube cleaning, said launcher including a barrel adapted for alignment with a tube to be cleaned for delivering a projectile into said tube, a cleaning medium supply duct movable through said barrel to move said projectile into the tube to be cleaned, said cleaning medium supply duct being movable into the tube to be cleaned and including a resilient annular member connected to an end of the duct whereby pressurized cleaning medium supplied through said duct presses the resilient annular member against an inner wall surface of the tube to be cleaned to seal thereagainst.

Where the movable support arrangement for a launcher is such that small positional errors occur between the launcher barrel muzzle and the ends of tubes to be cleaned, ingress of a projectile to the end of a tube to be cleaned may be facilitated by allowing the barrel muzzle a small degree of freedom of movement in a radial sense.

BRIEF DESCRIPTION OF THE DRAWINGS

The various aspects of the present invention will be more readily understood from the following description given in relation to the accompanying drawings, in which.

DETAILED DESCRIPTION OF THE PREFERRED EMBODIMENTS

Figure 1:
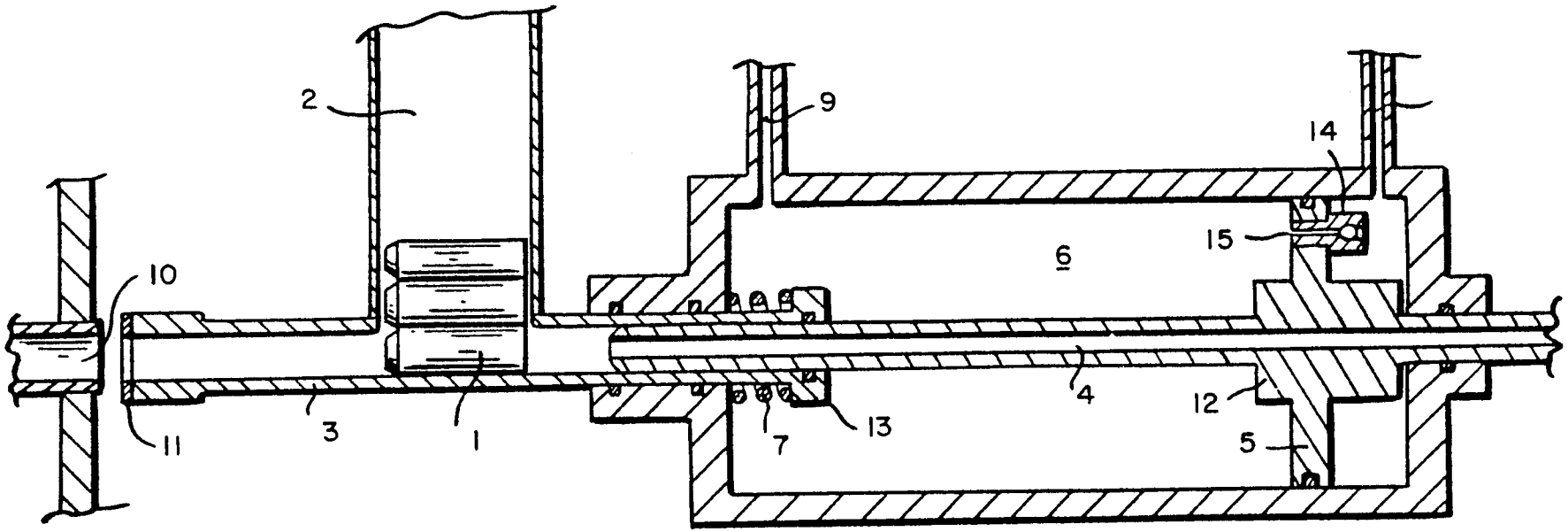
FIG. 1 is a longitudinal sectional view of a simple launcher device illustrated and described in the aforementioned prior art patent specifications.

With reference to FIG. 1, projectiles 1 are carried in storage magazine 2 such that the lowermost projectile 1 rests in barrel 3 of the launcher. The barrel 3 is slidably accommodated in the end of a hydraulic cylinder 6. Cleaning medium duct 4 is made coaxial with piston 5 which is slidably accommodated within the said hydraulic cylinder 6 and, with the said piston in its rearmost position, extends into the inner end of the barrel 3. Hydraulic pressure applied through inlet 8 to the rear face of the piston 5 causes the piston to move forward in the hydraulic cylinder 6, causing the cleaning medium duct 4 to pass along the barrel 3. The projectile 1 in the barrel 3 is carried by the cleaning medium duct 4 along the barrel and into the tube 10 to be cleaned, the final forward movement of the said piston causing shoulder 12 to abut a flange 13 at the inner end of the barrel 3 and push the said barrel forward against a spring 7. As a result, the muzzle 11 of the barrel is pressed firmly against tube 10. A flow of pressurized cleaning medium is then released by a quick release valve (not shown) which, passing through the said cleaning medium duct 4, rapidly fills tube 10, propelling projectile 1 through it and generating the required cleaning effect.

Following passage of the projectile through the tube, the launcher is recycled by the application through inlet 9 of hydraulic pressure to the front face of piston 5. The said piston moves to the rear of cylinder 6, withdrawing the cleaning medium duct 4 with it until the outer end of the duct comes to rest at a point in barrel 3 rearward of storage magazine 2. The disengagement of piston shoulder 12 from barrel flange 13 permits the pressure of spring 7 to retract the said barrel inward, disengaging its muzzle 11 from tube 10. With the front of hydraulic cylinder 6 pressurized through inlet 9, a partial pressure loss occurs through a calibrated bleed 15 and non return valve 14, ensuring that hydraulic pressure does not impede the retraction inward of the barrel 3.

Following its recycling, the launcher is then repositioned by an X/Y axis support arrangement (not shown) adjacent to the end of and collinear with another tube to be cleaned, and the cleaning cycle is repeated.

Figure 2:
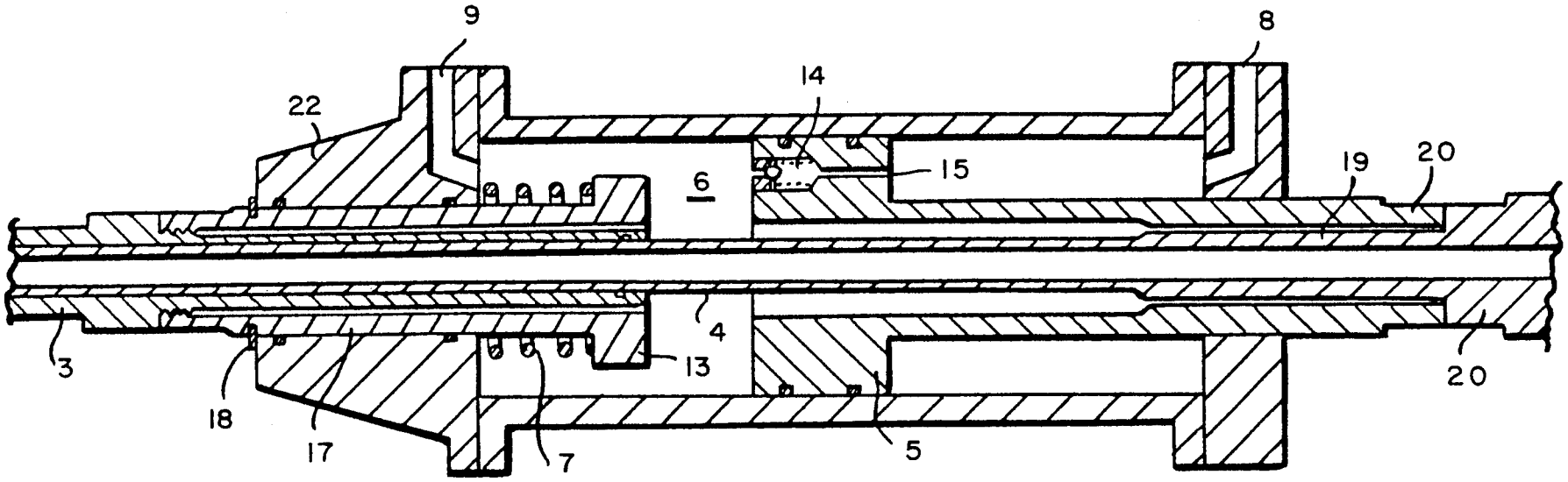
FIG. 2 is a longitudinal sectional view of an improved form of launcher in which the barrel and cleaning medium duct may be changed to accommodate projectiles of different diameters.

With reference to FIG. 2, an improved form of launcher is disclosed having the same principle of operation as that depicted in FIG. 1, the design being developed to permit the changing of the barrel and its mating cleaning medium duct to accommodate projectiles of different diameters. In the present arrangement, piston 5, slidably accommodated within hydraulic cylinder 6, is provided with cylindrical extension 16 into the outer end of which boss 19 of cleaning medium duct 4 is screwed. Flats 20 are provided on the said boss and cylindrical extension to facilitate tightening of their screwed connection. Barrel 3 is screwed into and supported by barrel support member 17 which is slidably accommodated in the end of the said hydraulic cylinder. Flats 21 are provided on the said barrel and barrel support member to facilitate tightening of their screwed connection. The said barrel support member is retracted inwards by pressure of spring 7, its travel being limited by circlip 18 abutting hydraulic cylinder front cover 22. A combination of barrel and cleaning medium duct is changed by holding barrel support member 17 against rotation and unscrewing and removing barrel 3, and holding piston cylindrical extension 16 against rotation and unscrewing and removing cleaning medium duct 4. It can be seen that removal of either component will result in loss of hydraulic fluid from hydraulic cylinder 6. The said barrel and cleaning medium duct are then replaced with complementary units of a different barrel diameter.

Figure 3:
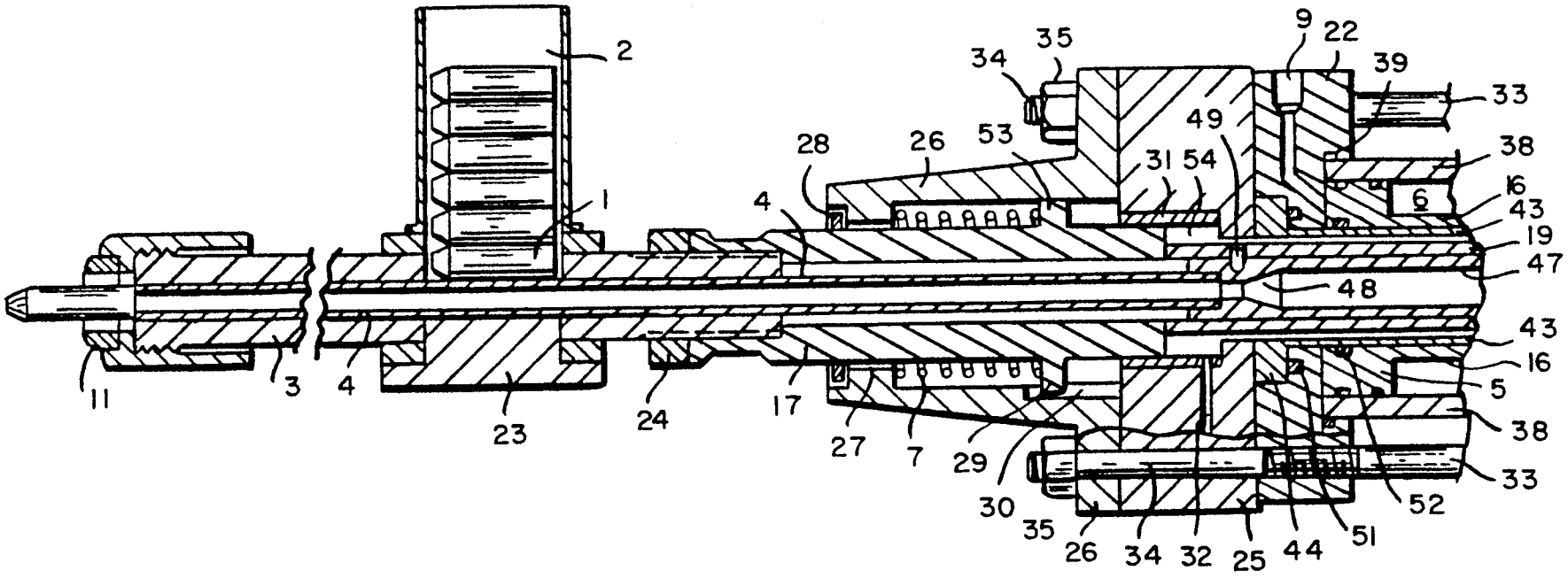
FIGS. 3 and 4 are longitudinal sectional views of a further preferred embodiment of a launcher in which the barrel and a cleaning medium duct may be changed to accommodate projectiles of different sizes without loss of pressurized actuating medium.
Figure 4:
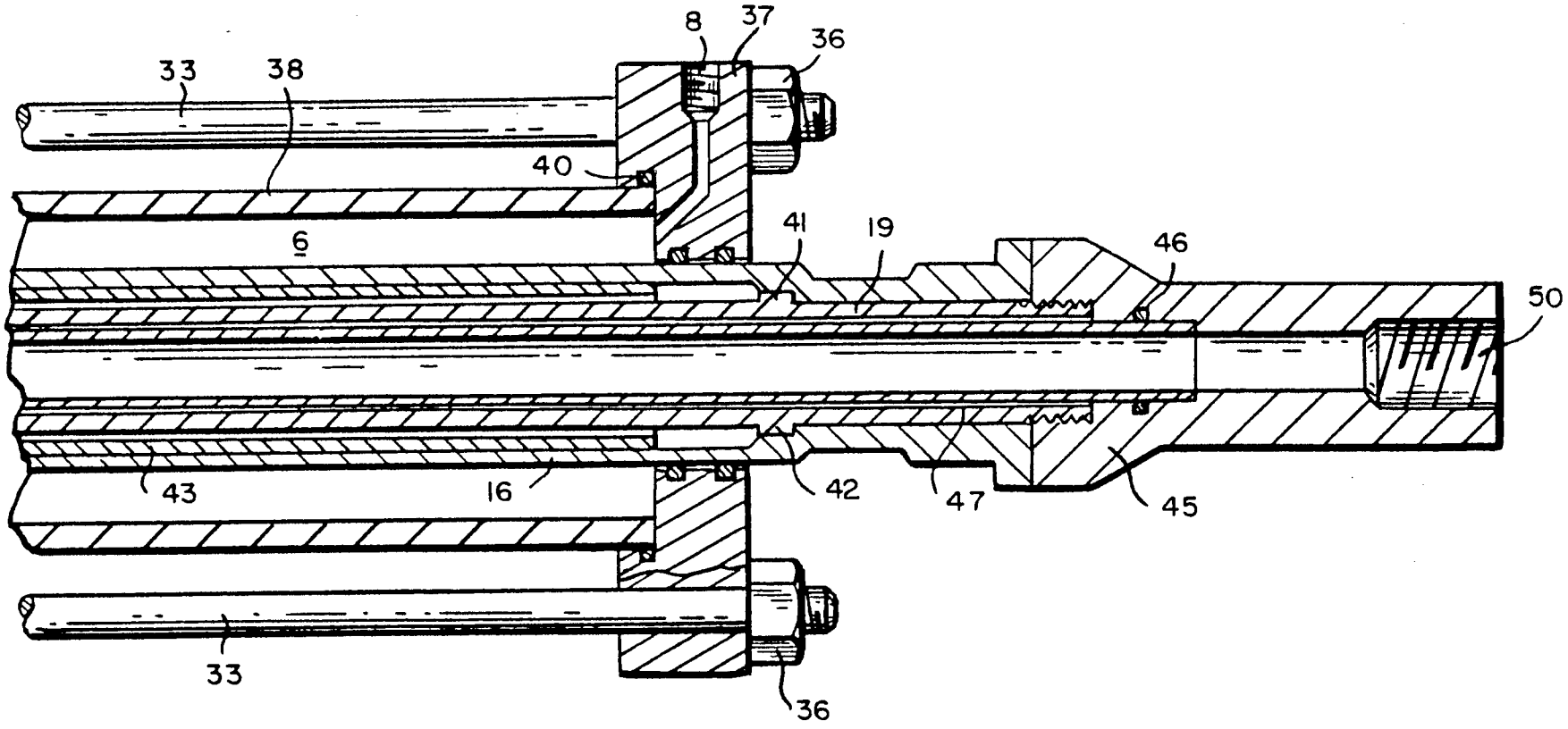

With reference to FIGS. 3 and 4, in which additional sectioning is shown to disclose details of clamping bolts, a further improved form of launcher is depicted. In this embodiment, piston 5 is slidably accommodated within hydraulic cylinder 6 and is provided with cylindrical extension 16 which passes out through rear cover 37 of the said hydraulic cylinder. Hydraulic cylinder 6 comprises cylindrical body member 38 which is closed by front cover 22 and rear cover 37, the joints being sealed respectively by "O" rings 39 and 40 accommodated within suitable grooves in the said covers. Clamping bolts 33 pass through end cover 37 and are screwed into front cover 22, a forward extension of each bolt 34, of reduced diameter, passing through mounting member 25 and barrel retraction spring housing 26. The said barrel retraction spring housing and mounting member are clamped to front cover 22 by tightening of nuts 35 onto threads on the forward ends of clamping bolt extensions 34. The said hydraulic cylinder components are clamped together by tightening of nuts 36 onto threads on the rearmost ends of clamping bolts 33. Accommodated inside piston 5 and its cylindrical extension 16 is sealing sleeve 43, the mounting flange 44 of which is captured between front cover 22 and mounting member 25 and sealed by "O" ring 51. The said piston and its cylindrical extension are free to slide over the said sealing sleeve, the inner face of the said piston being sealed to the said sealing sleeve by seal 52. Slidably accommodated within sealing sleeve 43 and housed in the rearmost end of piston cylindrical extension 16 is cleaning medium duct support sleeve 19. The rearmost end of the said cleaning medium duct support sleeve 19 projects beyond the end of piston cylindrical extension 16 and is threaded, onto which thread is screwed terminal fitting 45, the tightening of the said screwed connection resulting in shoulder 41 of the said cleaning medium duct support sleeve abutting shoulder 42 on the inner face of the said piston cylindrical extension. Flats are provided upon the said piston cylindrical extension and terminal fitting to facilitate tightening of their screwed connection. Accommodated within the said cleaning medium duct support sleeve 19, its outer end housed within terminal fitting 45 and sealed to it by "O" ring 46, is cleaning medium duct inner part 47. The said cleaning medium duct inner part 47 terminates within the forward end of its support sleeve 19, in all but the largest size of cleaning medium duct for which provision is made, in a concentric reducer 48. The forward ends of the said cleaning medium duct inner part and its support sleeve are locked together by means of grub screw 49. Screwed into the forward end of cleaning medium duct inner part 47 is cleaning medium duct outer part 4 which extends along the inside of barrel 3. Where the said cleaning medium duct inner and outer parts are of the same diameter, as is the case with the largest diameter for which provision is made, the said cleaning medium duct inner and outer parts are made as a single unit. Barrel 3 is screwably accommodated in the front of barrel support member 17 which is in turn slidably accommodated within barrel retraction spring housing 26 and supported in a precision fitted bushing 27 in the front of the said barrel retraction spring housing and in a second precision fitted bushing 31 in mounting member 25. Seal 28 prevents the ingress of water to the said barrel retraction spring housing. Barrel support member 17 is prevented from rotating by lug 29 on flange 53 engaging keyway 30 in the inner face of the said barrel retraction spring housing. Barrel support member 17 is retracted inwards by the pressure of barrel retraction spring 7 on flange 53. The said barrel is locked to its support member by locking nut 24. Flats are provided on the said barrel and its support member to facilitate tightening of their screwed connection and tightening of the said locking nut. Bushed recess 54 in mounting member 25 in which the inner end of barrel support member 17 is accommodated is vented and drained by drilling 32. Projectiles 1 are accommodated within storage magazine 2. A corresponding slot in barrel 3 opposite the said storage magazine is closed by closure 23, the removal of which permits the use of projectiles carried in a belt arrangement. Mounting member 25 is radially expanded as required to provide a strong means of mounting the launcher. In operation, with piston 5 in its rearmost position in hydraulic cylinder 6, the outer end of cleaning medium duct outer part 4 extends into barrel 3 to a point rearward of projectile storage magazine 2.

A projectile 1 is inserted in the said barrel. The entry of pressurized hydraulic fluid through inlet 8 and venting of hydraulic fluid through inlet 9 causes the said piston to move forward bringing with it its cylindrical extension 16, cleaning medium duct support sleeve 19, terminal fitting 45, cleaning medium duct inner part 47 and cleaning medium duct outer part 4. The said projectile resting in the said barrel is carried forward by the outer end of the said cleaning medium duct outer part and lodged in the tube to be cleaned which is collinear with and adjacent to the muzzle of the said barrel. The final forward travel of the said piston and its accompanying components causes the forward end of cleaning medium duct support sleeve 19 to abut the rear face of barrel support member 17, pushing it and barrel 3 forward until barrel muzzle 11 is brought firmly into contact with the end of the said tube to be cleaned. A flow of high pressure cleaning medium is then released by a quick release valve, entering at inlet fitting 50 of terminal fitting 45 and passing up cleaning medium duct inner and outer parts 47 and 4 to fill the tube to be cleaned, propelling the said projectile through it and effecting the cleaning process. Upon changing the barrel 3 and cleaning medium duct 4 to accommodate projectiles 1 of different sizes, leakage of hydraulic fluid from the cylinder 6 is prevented by co-operation of the sealing rings 51, 52 with mating components.

Figure 5:
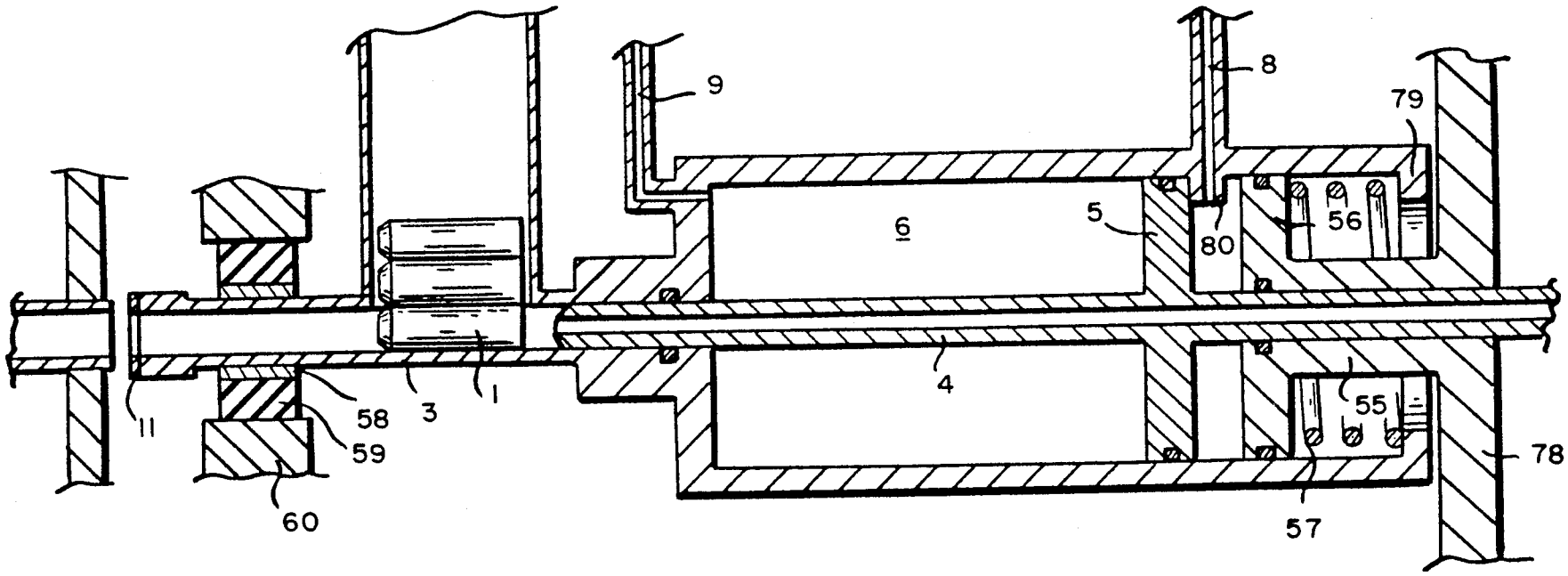
FIG. 5 is a longitudinal sectional view of a further variation of launcher in which the barrel is made fixed and the device is mounted on a piston slidably accommodated in the end of the cylinder.

With reference to FIG. 5, an improved form of launcher is depicted which is similar in arrangement to that depicted in FIG. 1, expecting that barrel 3 is fixed to the front of hydraulic cylinder 6 and the rear of the said hydraulic cylinder is closed with a piston 56 slidably accommodated within it. The said barrel 3 is slidably supported in a bushing 58 which is carried in an elastomeric bushing 59 accommodated in a fixed mounting 60. The said elastomeric bushing permits a small degree of radial movement at the muzzle 11 of the said barrel. Piston 56 is connected by mounting column 55 to mounting 78, cleaning medium duct 4 passing coaxially through all three components. Mounting 78 may be fixed rigidly to the support arrangement for the cleaning device. The said piston is refracted inward by the pressure of mounting retraction spring 57 acting against flange 79, the said flange serving to limit rearward movement of the said piston. In operation, the entry of pressurized hydraulic fluid to hydraulic cylinder 6 through inlet 8 as hydraulic fluid is vented from inlet 9 causes piston 5 to move forward, carrying with it cleaning medium duct 4, the passage of the said cleaning medium duct up barrel 3 serving to load projectile 1 into tube 10 to be cleaned in the manner hereinbefore described. When piston 56 reaches the limit of its forward travel, the resultant pressure rise in hydraulic cylinder 6 causes the said cylinder to move bodily forward, piston 56 moving rearward in the said cylinder against the pressure of mounting retraction spring 57 and barrel 3 slides in bushing 58 until barrel muzzle 11 is brought firmly into contact with the end of tube 10 to be cleaned. Cleaning of the said tube is then effected by the propulsion of the projectile through it by a flow of pressurized cleaning medium delivered through cleaning medium duct 4 in the manner hereinbefore described. The entry of pressurized hydraulic fluid to hydraulic cylinder 6 through inlet 9 as hydraulic fluid is vented from inlet 8 causes piston 5 to retract rearward, carrying with it cleaning medium duct 4, until it abuts lug 80. Simultaneously, the pressure of mounting retraction spring 57 causes hydraulic cylinder 6 to move bodily rearward, barrel 3 sliding in bushing 58 and disengaging barrel muzzle 11 from the end of tube 10. The launcher is then repositioned with its barrel muzzle adjacent to and collinear with another tube to be cleaned and the cleaning cycle repeated.

Figure 6:
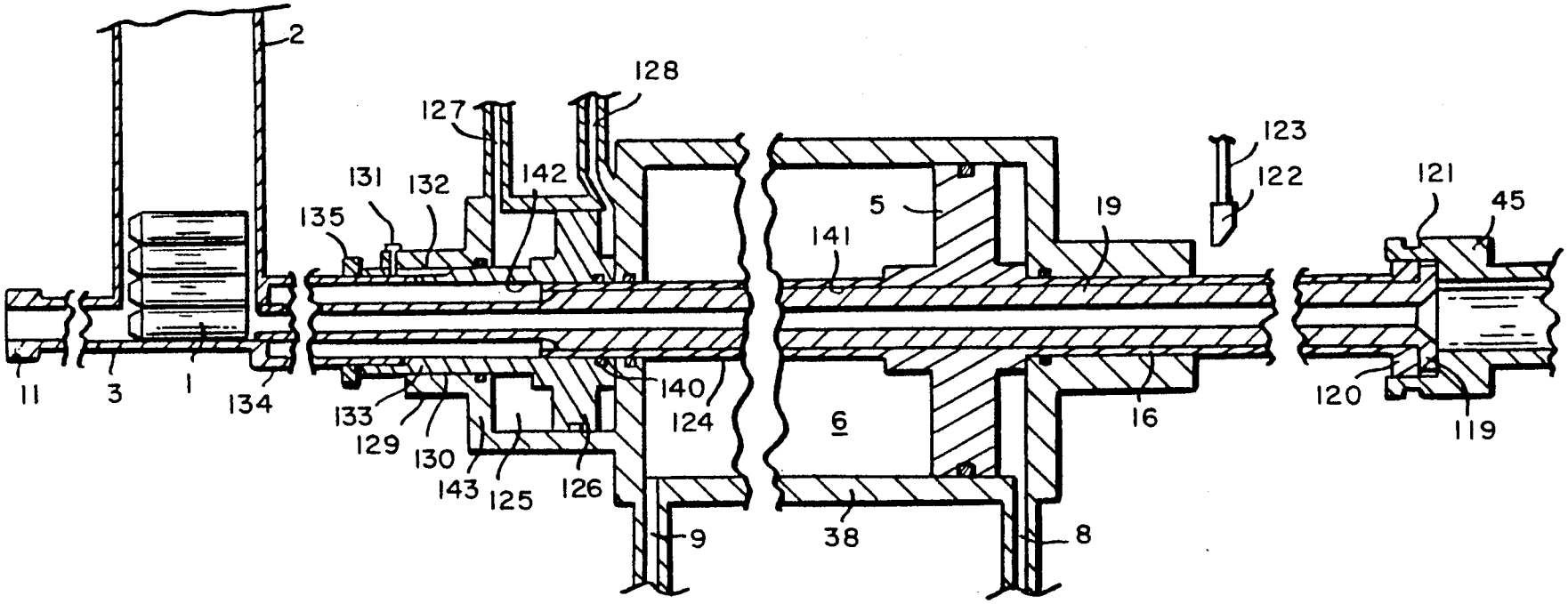
FIG. 6 is a longitudinal cross-sectional view of a still further variation of a launcher arrangement in which the piston in the power cylinder is actuated by a compressible fluid.

With reference to FIG. 6, a launcher is depicted in which the action of the cleaning medium duct is controlled by a piston moved in a cylinder through the agency of a compressed gas and in which the extension of the barrel is controlled by another piston moved in another cylinder through the agency of pressurized hydraulic fluid. Piston 5 is slidably accommodated within cylinder 6 and is moved through the agency of compressed gas entering or exhausting through inlets 8 and 9. The said piston is provided with hollow elongated cylindrical extensions 124 and 16 extending respectively forwardly and rearwardly out through seals in the front and rear parts of casing 38 of cylinder 6. The said piston is made with a coaxial bore which forms, together with the hollow interiors of the said elongated cylindrical extensions, a single long cylindrical bore 141 of uniform diameter. Formed on the front part of the said cylinder casing is cylinder 125 in which is slidably accommodated piston 126 which is moved through the medium of pressurized hydraulic fluid entering or exhausting through inlets 127 and 128. Piston 126 is provided with a hollow elongated cylindrical extension which extends forwardly out through seals in the forward part of casing 143 of the said cylinder. Piston 126 is made with a coaxial bore which, together with the hollow part of its cylindrical extension 133, creates a single bore 142 of uniform diameter. Forward cylindrical extension 124 of piston 5, after passing through the front part of cylinder 6, is slidably accommodated within bore 142 of piston 126 and its forward extension 133 and is sealed to the said piston by seal 140. Cylindrical piston extension 133 is slidably supported in bearing 130 carried in housing 129 formed on the front face of cylinder casing 143. The said cylindrical piston extension is provided with axial groove 132 in which is slidably accommodated the end of locating bolt 131 which is screwed into housing 129, the said arrangement preventing rotation of cylindrical piston extension 133. Screwed into the forward end of the said cylindrical extension of piston 126 is the barrel assembly comprising muzzle 11, barrel 3, projectile storage magazine 2 and barrel base 134, the whole being locked into positional relationship with the said piston cylindrical extension by locking nut 135. Barrel base 134 is made hollow so as to slidably accommodate the forward cylindrical extension 124 of piston 5 during the forward limit of its travel.

Accommodated within bore 141 of piston 5 and its forward and rearward cylindrical extension 124 and 16 is cleaning medium duct body part 19 which terminates at its rearward end in flange 119. The forward part of the said cleaning medium duct body part is formed into cleaning medium duct 4 which is slidably accommodated within barrel 3. The rearward cylindrical extension 16 of piston 5 terminates in boss 120 which is threaded on its outer peripheral face. Cleaning medium body part 19 is captured within bore 141 by its end flange 119 being imprisoned by the screwing of terminal nut 45 onto threaded boss 120. Terminal nut 45 is provided with circumferential groove 121 which is adapted to receive the tongue of latch 122 at the forward extremity of travel of the said terminal nut. Latch 122 is withdrawn by actuating rod 123 operated by actuator (not shown). In operation, compressed gas is admitted to cylinder 6 through inlet 8 causing piston 5 to move forward in the said cylinder and cleaning medium duct 4 to pass up barrel 3 carrying with it projectile 1 into a tube to be cleaned. The said piston and cleaning medium duct are locked into position at their forward limit of travel by latch 122 engaging groove 121 of terminal nut 45. Pressurized hydraulic fluid is then admitted through inlet 128, causing piston 126 to move forward and clamp barrel muzzle 11 firmly against the end of a tube to be cleaned (not shown). Cleaning of the tube is then effected by the propulsion of the projectile through it by the instantaneous release of a flow of high pressure water. Projectiles of large or smaller diameter may be accommodated by changing the barrel group members 11, 3, 2 and 134 cleaning medium duct body part 19 and cleaning medium duct 4. The said barrel group members are changed by loosening locking nut 135 and unscrewing them from forward cylindrical extension 133 of piston 126.

Cleaning medium duct body part 19 and cleaning medium duct 4 are removed by unscrewing terminal nut 45 from threaded boss 120 and withdrawing the said components. New components of the desired diameter are then installed by reversing the aforesaid process.

Although they may not be specifically described herein, all spaces and sliding surfaces subject to pressurized media, are sealed by suitable gaskets, "O" rings or seals.

Figure 7:
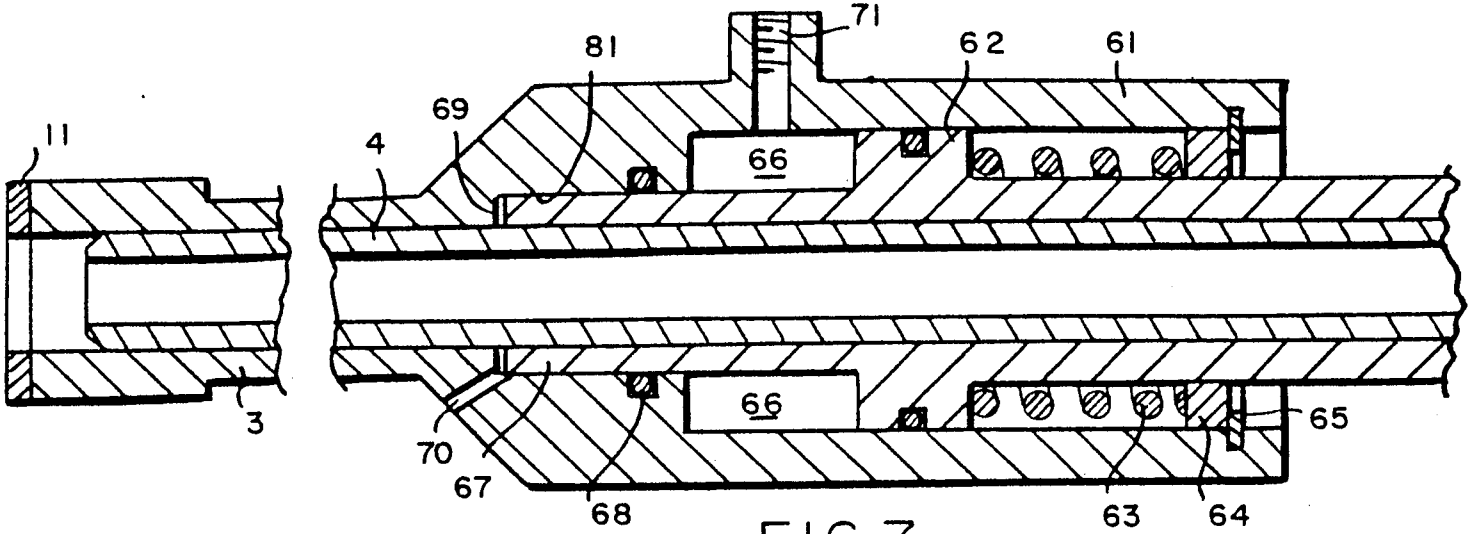
FIG. 7 is a longitudinal sectional view of part of a launcher arrangement by which the barrel may be extended by means of a piston and cylinder arrangement incorporated therein.

With reference to FIG. 7, barrel 3 of a launcher is made in two parts, one part of which is provided with piston 62 slidably accommodated within cylinder 61 formed on the other part. A cylindrical extension 67 beyond piston 62 of the inner part of barrel 3 slidably accommodated within bore 81 formed in the outer part of barrel 3, and sealed to it by seal 68. Space 69, between the end of cylindrical extension 67 and the bottom of bore 81, when they are not abutting, is vented through vent 70. The pressure of barrel retraction spring 63 against collar 64, which is retained by circlip 65, causes cylinder 61 to retract over piston 62 until cylindrical extension 67 is bottomed in bore 81. The entry of pressurized hydraulic fluid through inlet 71 to cylinder space 66 causes cylinder 61 to move slidably forward over piston 62, forcing barrel muzzle 11 firmly into contact with the end of a tube to be cleaned. The forward travel of cylinder 61 is limited by the binding of the coils of barrel retraction spring 63 before the end of cylindrical extension 67 reaches seal 68. The part of barrel 3 shown cut away between cylinder 61 and muzzle 11 is provided with a storage magazine for the accommodation of projectiles as described in other configurations of launcher. Cleaning medium duct 4 operates in the same way as described for other configurations of launcher to carry projectiles from said storage magazine, up the said barrel and into a tube to be cleaned. The said cleaning medium duct is actuated by a piston (not shown) slidably accommodated within a cylinder (not shown) and operated by pneumatic or hydraulic pressure. The position of the piston and cylinder, on the inner and outer barrel parts respectively, may obviously be reversed.

Figure 8:
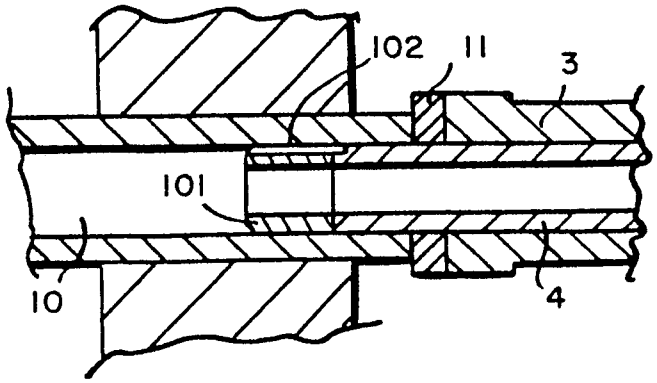
FIG. 8 is a longitudinal sectional view of one method of sealing the barrel muzzle of a cleaning device to a tube to be cleaned.

With reference to FIG. 8, where the ends of tubes are corroded or not evenly formed, difficulty may be experienced in maintaining a satisfactory seal between them and the plain barrel muzzle of a launcher. To overcome this problem, the stroke of the actuating piston (not shown) of a launcher is adjusted such that, when the piston is in its fully forward position, cleaning medium duct 4 extends beyond muzzle 11 of barrel 3 and into tube 10 to be cleaned. The end of the said cleaning medium duct is provided with sealing sleeve 101 which is made of some suitable stiff elastomeric material and which makes a light sliding fit with the internal surface of tube 10. In operation, the releasing of a flow of pressurized cleaning medium through cleaning medium duct 4 expends sealing sleeve 101 against the internal surface of tube 10 creating a positive seal between the end of the said cleaning medium duct and the tube. To minimize distortion of sealing sleeve 101 when pushing a projectile (not shown) from barrel 3 into tube 10, the said sealing sleeve may be rendered more rigid in an axial sense by the incorporation into it of a plurality of stiffening members 102 passing axially throughout its length and preferably set into suitable holes or drillings in the end of cleaning medium duct 4.

Figure 9:
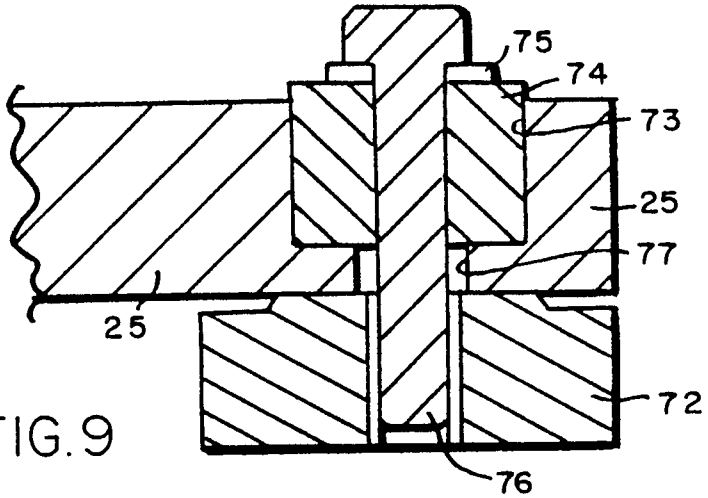
FIG. 9 is a sectional view of an arrangement by which a launcher proper may be mounted so as to permit a small amount of radial movement at the barrel muzzle.

With reference to FIG. 9, a launcher is mounted in such a way as to permit a small degree of radial movement at its barrel muzzle. Mounting 25 is provided with cylindrical recess 73, the depth of the said cylindrical recess extending for most of the thickness of the said mounting. Passing through the remaining thickness of the said mounting is piercing 77, the diameter of which is such as to provide a suitable degree of radial clearance around mounting bolt 76. Accommodated within the said cylindrical recess is elastormeric bushing 74, through a bore in the centre of which passes the said mounting bolt which is screwed into a threaded bore in mounting bracket 72. Washer 75 is provided beneath the head of the said mounting bolt to prevent it from embedding itself into the said elastomeric bushing.

In operation, clamping or recoil forces cause mounting 25 to bear back directly against mounting bracket 72. During the placement of a projectile in a tube to be cleaned, in the manner previously described, should the axis of the launcher barrel not be exactly collinear with that of the tube, the tapered nose of the projectile will act as a spigot and bring the two into alignment through distortion of mounting elastomeric bushing 74. The projectile will continue to act as a locating spigot during the clamping of the barrel muzzle against the end of the tube to be cleaned.

What is claimed is:

1. A launcher for placing projectiles of different preselected sizes into a tube to be cleaned and enabling a cleaning medium to be supplied to a projectile placed in a tube to be cleaned and to propel said projectile along said tube during a cleaning operation, said launcher comprising:

a barrel alignable with the tube to be cleaned, projectile supply means for feeding a projectile into said barrel, a moveable cleaning medium duct slidably accommodated in said barrel and adapted to push the projectile located in said barrel into the tube to be cleaned upon movement of said moveable cleaning medium duct forwardly along said barrel, means enabling movement of at least an end zone of said barrel into engagement with or around the tube to be cleaned, means enabling movement of said moveable cleaning medium duct, and means for directing a cleaning medium pulse along said moveable cleaning medium duct against the projectile previously located in said tube to be cleaned, said launcher being characterized in that said barrel is selectably removable from said launcher to enable the use of differing sized projectiles in the cleaning of said tubes.

2. A launcher according to claim 1, wherein said cleaning medium duct is selectably removable from said launcher.

3. A launcher according to claim 1, wherein the cleaning medium duct further includes a piston member which is selectably movable along the operating cylinder of said duct by means of a pressure medium acting on forward or rear faces of said piston member, said piston member having an annular axial extension part extending through a rear end wall of said operating cylinder in sealing engagement therewith, said piston member being operably associated with said cleaning medium duct to effect movement of said cleaning medium duct along said barrel.

4. A launcher according to claim 3, wherein a barrel support member is slidably mounted in a forward wall of said operating cylinder and urged by spring means in a direction towards said piston member, said barrel being releasably secured to said barrel support member, and said barrel support member is located to be moved in a forward direction against said spring means in response to movement of said piston member during at least a final portion of travel of said piston member in said forward direction.

5. A launcher according to claim 4, wherein said piston member engages said barrel support member.

6. A launcher according to claim 5, wherein said barrel support member extends at least partially into said operating cylinder.

7. A launcher according to claim 4, wherein said cleaning medium duct engages said barrel support member.

8. A launcher according to claim 3, wherein an annular sleeve extends axially from a forward end wall of said operating cylinder and inwardly of said piston member and said annular axial extension of said piston member, said piston member moving over said annular sleeve in sealing engagement therewith.

9. A launcher according to claim 8, wherein said cleaning medium duct includes an inner part and an outer part, said outer part being engagable with a barrel support member slidably mounted in the forward end wall of said operating cylinder to forwardly displace said barrel against inward urging spring means, said barrel support member being moved by engagement with said outer part of the cleaning medium duct against said spring means, said inner part of said cleaning medium duct extending forwardly through said barrel support member into said barrel and said outer part of said cleaning medium duct extending rearwardly through said annular sleeve, and said barrel being releasably secured to said barrel support member.

10. A launcher according to claim 1, wherein the cleaning medium duct further includes a piston member which is selectably movable along the operating cylinder of said duct by means of a pressure medium acting on forward and rear faces of said piston member, said piston member carrying said cleaning medium duct extending forwardly and rearwardly of said piston member through forward and rear ends of said operating cylinder, a forward part of said cleaning medium duct being movable through said forward end wall of said operating cylinder in sealing engagement therewith with said forward part extending into said barrel.

11. A launcher according to claim 1, which further comprises:

a first piston member, selectably movable along a first operating cylinder by means of a pressure medium acting on forward and rear faces of said first piston member, said first piston member carrying forward and rearward axial extending annular sleeves slidably and sealingly engaged with forward and rearward ends walls of a first operating cylinder, said cleaning medium duct passing through said forward and rearward axially extending annular sleeves in a manner whereby movement of said first piston member effects movement of said cleaning medium duct, a forward end of said cleaning medium duct extending into said barrel, and a second piston member selectably movable in a second operating cylinder, said second operating cylinder having a central bore into which the forward axially extending annular sleeve extends, said second piston member having a forwardly extending annular sleeve member extending through and in sealing engagement with a forward end wall of the second operating cylinder, said forwardly extending annular sleeve member of the second piston member being releasably connected to said barrel.

12. A launcher according to claim 1, wherein the cleaning medium duct includes a sealing element at the open or free end of the duct adapted to engage with an internal circumferential surface of the tube to be cleaned.

* * * * *